US005330176A

United States Patent [19]

Cagney, Jr.

[11] Patent Number: 5,330,176

[45] Date of Patent: Jul. 19, 1994

[54] STANCE AND STRIDE TRAINING AID

[76] Inventor: Richard D. Cagney, Jr., 9314 Lawndale Ave., Evanston, Ill. 60203

[21] Appl. No.: 934,845

[22] Filed: Aug. 24, 1992

[51] Int. Cl.[5] ..... A63B 69/00

[52] U.S. Cl. ..... 273/26 R; 273/187 A

[58] Field of Search ..... 273/26 A, 183 A, 187 R, 273/187 B, 188 A, 195 R, 195 B, 29 A

[56] References Cited

U.S. PATENT DOCUMENTS

| | | | |
|---|---|---|---|
| 3,350,096 | 10/1967 | Kile et al. . | |
| 3,350,101 | 10/1967 | Bishop et al. | 273/187 R |
| 3,352,559 | 11/1967 | Larsen | 273/187 R |
| 3,815,906 | 6/1974 | Hermo . | |
| 3,918,073 | 11/1975 | Henderson et al. . | |
| 4,023,798 | 5/1977 | Pronin | 273/29 A |
| 4,146,231 | 3/1979 | Merkle | 273/187 R |
| 4,194,735 | 3/1980 | Wilson | 273/26 R |
| 4,258,916 | 3/1981 | Beam | 273/26 R |
| 4,461,477 | 7/1984 | Stewart | 273/26 R |
| 4,463,950 | 8/1984 | Elkin | 273/26 R |
| 4,544,160 | 10/1985 | Miner | 273/187 R |
| 4,805,913 | 2/1989 | Bott | 273/187 R |
| 4,932,656 | 6/1990 | Pierce | 273/26 R |
| 5,037,094 | 8/1991 | Johnson . | |

FOREIGN PATENT DOCUMENTS

| | | | |
|---|---|---|---|
| WO83/01202 | 4/1983 | PCT Int'l Appl. . | |
| 1305710 | 2/1973 | United Kingdom | 273/187 R |

OTHER PUBLICATIONS

Washington Post, Mar. 27, 1988, p. D-16.

*Primary Examiner*—Theatrice Brown

[57] ABSTRACT

A stance and stride training aid for determining and training individuals on a proper batting stance and a proper batting stride. The training aid provides for a home plate reference and two stance indicators positioned on opposite sides of the home plate reference. Each of the stance indicators is gridded into rows and columns to provide feet positioning sectors that are individually represented by numbers or letters of the alphabet. The training aid also provides for stride indicators which correspond to the rows from which they extend for indicating the proper stride when swinging a bat.

12 Claims, 4 Drawing Sheets

STANCE AND STRIDE TRAINING AID

FIELD OF THE INVENTION

This invention relates to an athletic training aid for instructing individuals in properly positioning their feet for batting. In particular, this invention relates to a training aid for instructing individuals on a proper batting stance and batting stride.

BACKGROUND AND SUMMARY OF THE INVENTION

Considering the sport of baseball, for example, most people can hit a ball with a bat without much difficulty. However, to properly hit the ball with maximum transfer of energy from the bat to the ball, a batter must have a proper stance and stride. The proper stance and stride, in turn, are dependent on the batter's individual dimensions, in particular, the length of his arms, his stride and his bat. Whether it is baseball, softball, or any other activities involving contact between a ball and a bat, the proper swing involves intricacies in timing, and the position of the batter in relation to a home plate or batting tee.

Many devices are known to instruct individuals in swinging a bat, a golf club, or even a racquet. However, generally such devices are either too cumbersome or too complicated for frequent use by younger participants. As such, these devices may require substantial adult participation for assembly and use. Moreover, many of these devices must be frequently repositioned to maintain a proper distance from the home plate or batting tee. In addition, many of these devices pose safety hazards as they have protruding or extending members which may trip or otherwise injure the participants.

In one embodiment of the present invention, the training aid comprises a body for providing a substantially planar surface where the surface comprises a home plate indicium and a stance indicium positioned adjacent the home plate indicium to provide a plurality of feet positioning sectors for indicating a proper stance for batting. The present invention may also provide a plurality of stride indicia which extend outwardly from the stance indicium to indicate a proper stride in accordance with the proper stance.

The home plate indicium provided by the present invention renders moot the need to otherwise provide for a home plate reference. More importantly, the inclusion of a home plate indicium on the surface of the training aid body ensures that the stance indicium remains at a constant predetermined distance from the home plate indicium for enabling the batter to maintain a particular physical relationship with the home plate indicium when he bats.

Also, the present invention provides for distinct locator symbols in each of the feet positioning sectors so that after determining the stance most suited to him, the batter can repeatedly position himself without difficulty. This is particularly helpful to the younger participants where once their individual proper stances have been determined, each youngster can easily recall his predetermined locator numbers or letters of the alphabet to properly position himself on the stance indicium.

Instruction indicia, for example, diagrams illustrating use of the present invention, are also provided on the body of the training aid. The diagrams are simple and easily understood. As such, they instruct participants of all ages on how to properly use the training aid for determining the proper batting stance and stride.

In addition, the construction of the present invention enables easy transport and maintenance. In one embodiment, the body is composed of material that is light, flexible, washable, and substantially waterresistant. In such a form, the present invention can be effortlessly carried and cared for by youngsters.

These as well as other aspects of the present invention will become apparent from the detailed description which follows, considered together with the appended drawings.

DESCRIPTIONS OF THE DRAWINGS

A preferred embodiment of the present invention is shown in the following drawings, in which like reference numerals indicate like parts and in which:

FIGS. 1, 1*a* and 1*b* are perspective views of a stance and stride training aid constructed according to the present invention;

DESCRIPTION OF THE ILLUSTRATIVE EMBODIMENT

Figure 1:
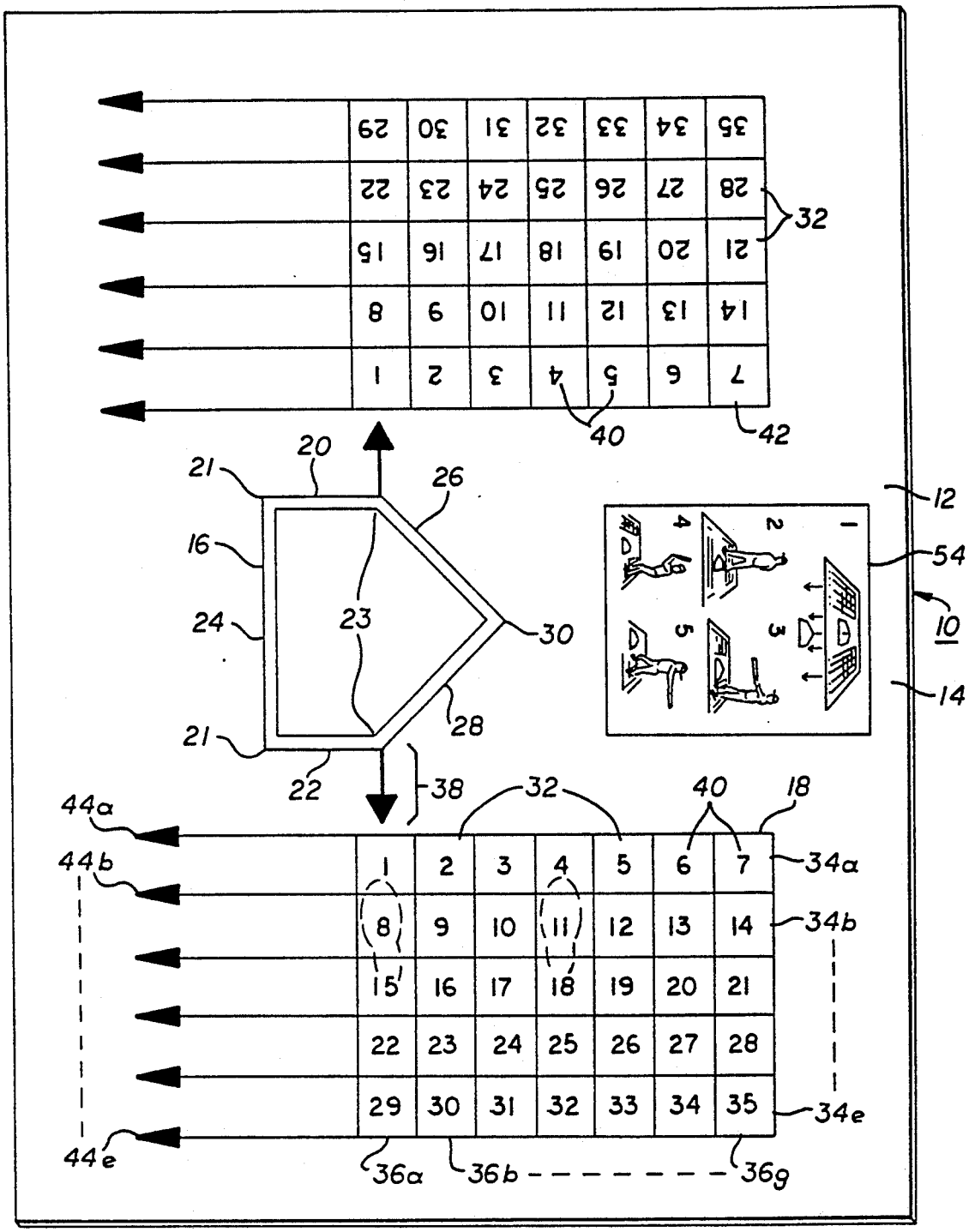

FIG. 1 shows generally a training aid 10 in accordance with an embodiment of the present invention. The training aid 10 includes a substantially planar body 12 that can be positioned on the ground, or any other foundation suitable for batting. The substantially planar body 12, in turn, defines or provides a surface 14 on which a batter can stand and bat.

The body 12 may be constructed of any material suited for wear and tear caused by athletic footwear whether or not equipped with cleats. The material may be flexible or rigid, however, in one embodiment it should be lightweight and easily cared for. In one successful embodiment, the material is reinforced nylon, which is substantially tear resistant and does not soil easily. Treated canvas is a suitable alternative in this respect in that it is durable and if soiled, it is easily laundered.

Figure 1A:
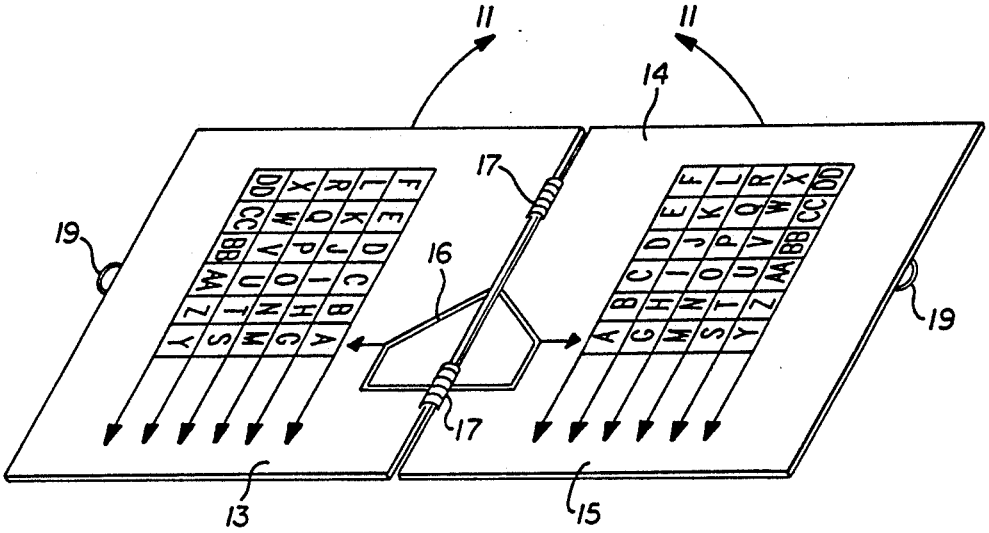

The material may also be acrylic, wooden, or other type of rigid materials, so long as it is able to withstand the weight of participants and remain substantially planar. FIG. 1 shows the body 12 to be of a continuous construction, in particular, a continuous sheet having the dimensions of 77 inches by 61 inches. The body 12 may also be constructed of a plurality of panels where the panels are movably joined to facilitate folding the body 12 for easy transport. As shown in FIG. 1*a*, adjacent edges of panels 13 and 15 may be joined by hinges 17 to facilitate folding the body 12 as shown by numerals 11. Flexible material (not shown) may also be attached to the adjacent edges to movably join the panels 13 and 15. Being folded, the training aid is easily transported and in this respect, handles 19 may be provided on end edges of the panels 13 and 15.

The surface 14 carries indicia including a home plate indicium 16 that is somewhat centered and a first stance indicium 18 arranged in relations to the home plate indicium 16 so that the indicia combined resemble a conventional home plate and a conventional batter's box.

The home plate indicium 16 and the first stance indicium 18 are marked or otherwise positioned on the surface 14 for providing a constant physical relationship there between. By providing the constant physical relationship, a batter using the stance indicium 18 is ensured of a constant physical relationship between himself and the home plate indicium 16. Accordingly, the batter need not repeatedly adjust the training aid 10 before he bats.

Figure 1B:
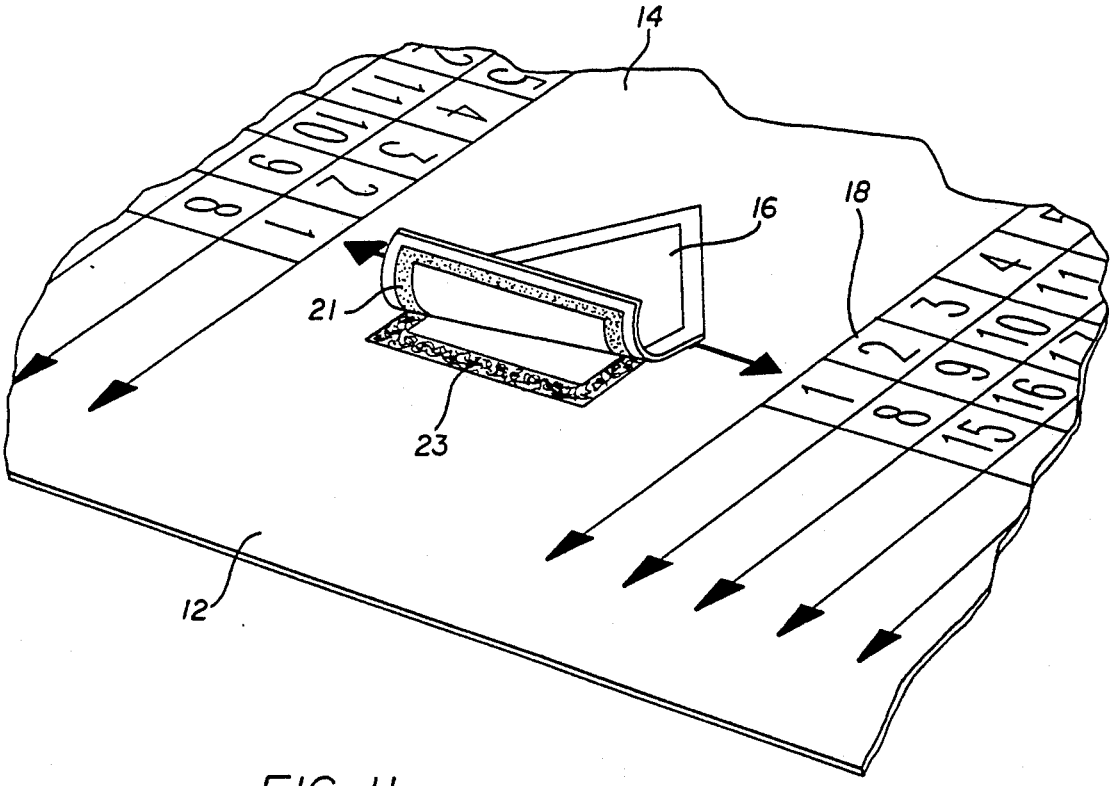

The indicia 16 and 18 may be deposited directly on the surface 14 by silkscreening, or like processes. Moreover, as shown in FIG. 1*b*, the home plate indicium 16 may also be composed of material similar to that of the body 12 and may be removably attached to the surface 14 by, for example, Velcro ® 21 affixed to underside of the home plate indicium 16 where the Velcro ® 21 has a corresponding mate 23 affixed to the surface 14. Constructed in this manner, the home plate indicium 16, when attached to the surface 14, is in the constant predetermined distance to the stance indicium 18, but may be easily removed to facilitate cleaning or laundering thereof.

Referring back to FIG. 1, by providing a home plate indicium 16 that is configured as a conventional home plate, the training aid 10 can be used whether or not a home plate is otherwise provided. So configured, the home plate indicium 16 has two side edges 20 and 22 connected at one end 21 by a front edge 24 (left as shown) substantially normal to the two side edges 20 and 22. The two side edges 20 and 22 are connected at their ends 23 by angled edges 26 and 28 respectively which converge to a pointed end 30 of the home plate indicium 16. In the disclosed embodiment, the front edge 24 is approximately 17 inches in length, the side edges 20 and 22 are each approximately 8.5 inches in length, and the two angled edges 26 and 28 are each approximately 12 inches in length.

The stance indicium 18 has a plurality of individual feet positioning sectors 32 for indicating positions of the batter's feet (as shown in phantom lines) when he is in his proper stance. In one embodiment, the stance indicium 18 is gridded so that the feet positioning sectors 32 are substantially rectangular and arranged in rows 34*a*–34*e* and columns 36*a*–36*g*. In the disclosed embodiment, the stance indicium 18 is approximately 22 inches by 30 inches where each of the feet positioning sectors 32 is approximately four inches by four inches.

The stance indicium 18 is positioned adjacent the home plate indicium 16 so that the smallest or youngest of participants may fully utilize the training aid 10. This aspect will become clear when use of the training aid 10 is fully discussed later herein. Specifically, in the disclosed embodiment, the stance indicium 18 is positioned so that the row 34*a* is substantially six inches from the side edge 22 of the home plate indicium 16 as indicated by numeral 38.

Within each of the feet positioning sectors 32 is a distinct locator symbol 40, such as numbers or letters of the alphabet. The numbers or letters may be arranged in sequence so as to facilitate the participants memorizing their positions for a proper batting stance. By providing the distinct locator symbol 40 in each of the feet positioning sectors, the batter need only memorize two distinct locator symbols as opposed to a distinct row designation and a distinct column designation for each foot. This feature toward simplicity particularly caters to the younger participants.

FIG. 1 also shows a second stance indicium 42 that is arranged somewhat like a mirror image of the first stance indicium 18 on the surface 14, that is, in a manner similar to that of the first stance indicium 18 with respect to the home plate indicium 16. However, the second stance indicium 42 is adjacent the side edge 20 to oppose the first stance indicium 18. So arranged, the training aid 10 may be used to train left-handed batters, as well as right-handed batters. The second stance indicium 42 is also gridded in a manner similar to the gridding in the first stance indicium 18 for providing the plurality of feet positioning sectors 32 arranged in the rows 34*a*–34*e* and the columns 36*a*–36*g* with the distinct locator symbols 40.

In order to instruct a batter on the proper stride when swinging a bat, the training aid 10 also carries a plurality of stride indicia 44*a*–44*e* on the surface 14 (FIG. 1, lower left). In the disclosed embodiment, the stride indicia 44*a*–44*e* are linear designations, for example, arrows, which extend outwardly from and are parallel to the rows 34*a*–34*e*. Each of the stride indicia 44*a*–44*e*. corresponds to one of the rows 34*a*–34*e*. from which it extends. As such, each of the stride indicia 44*a*–44*e*. indicates a stride that is proper for the corresponding row. In the disclosed embodiment, each of the arrows is substantially 18 inches in length.

Figure 2:
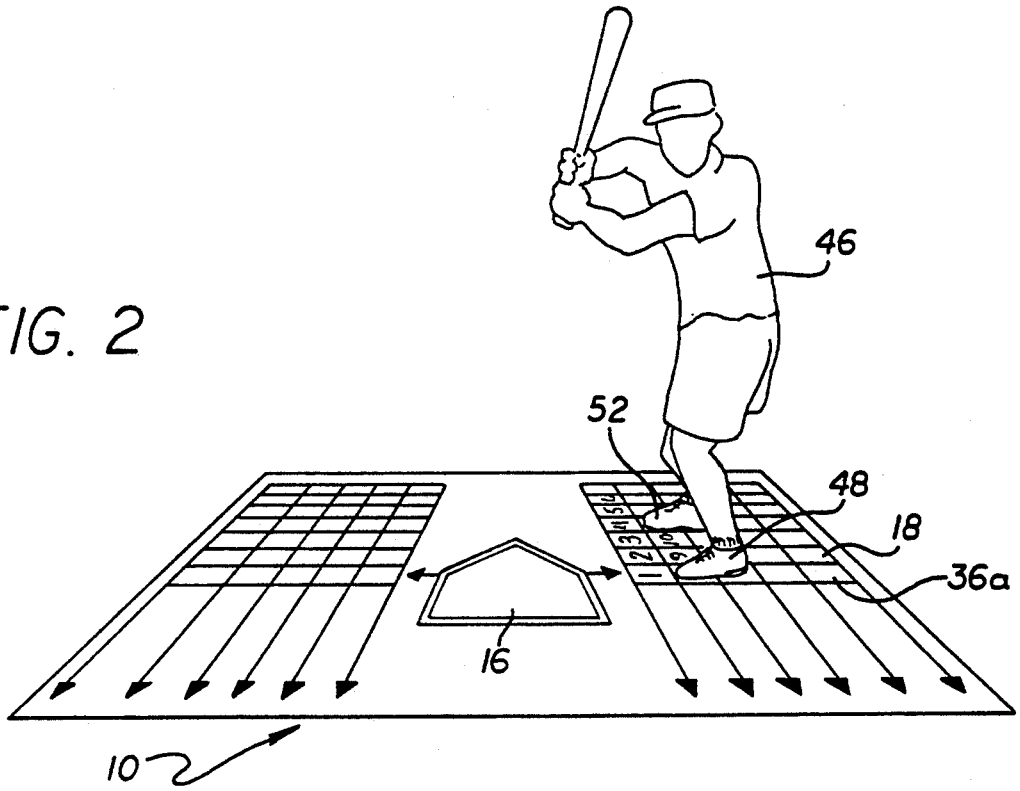
FIG. 2 is a perspective view illustrating an individual in a proper stance when determined in accordance with the present invention.

For a proper stance, a batter should be a particular distance away from a home plate and his feet should be sufficiently parted. FIG. 2 shows a batter 46 in a proper stance on the training aid 10 where his feet are not only parted at a width no more than approximately three inches wider than his shoulder width, but are positioned a certain distance from the home plate indicium 16. To ensure that the batter's feet are both sufficiently parted and sufficiently positioned away from the home plate indicium 16, the batter 46 simply places his feet, or his toes in particular, on two distinct locator symbols 40, the two locator symbols 40 having been earlier determined in accordance with the batter's arm length and bat length. Upon stepping in to a swing, the batter merely places his leading foot onto one of the stride indicium 44*a*–44*e*. (FIG. 5) for a proper batting stride.

Figure 3:
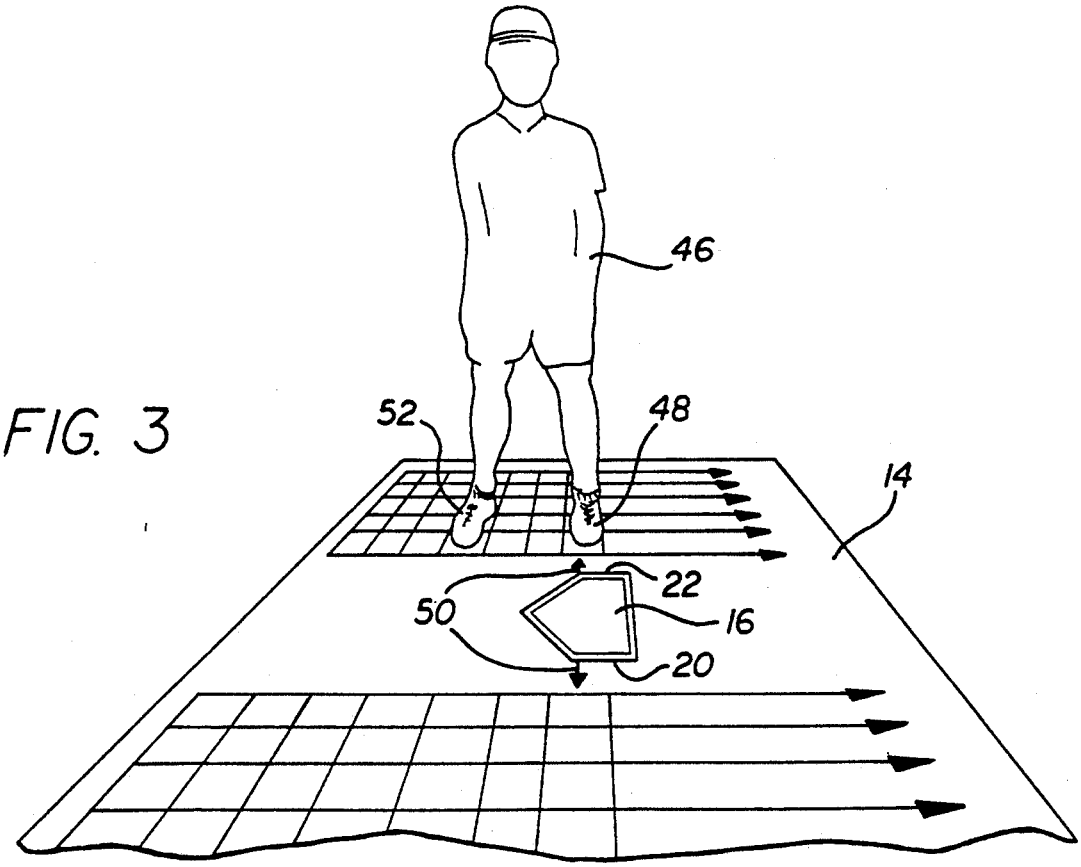
FIG. 3 is a perspective view illustrating commencement of determining a proper stance in accordance with the present invention.

To commence a determination of a proper stance and stride for a batter, FIG. 3 shows the batter 46 having his leading foot 48 on one of the feet positioning sectors 32 that is closest to the home base indicium 16, that is the only sector 32 which is in both the row 34*a* and the column 36*a*. In this position, the batter 46 faces the home plate indicium 16 and depending on whether the batter is right-handed or left-handed, one of the side edges 20 and 22 is closer to him while the other of the side edges 20 and 22 is farther. In FIG. 3, the home plate side edge closer to the batter 46 is the side edge 22 and, in the disclosed embodiment, the sector 32 closest to the home base indicium 16 displays the locator symbol "1". To help designate the "1" sector 32 as an initial starting point for determining the proper stance, a marker 50 is provided on the surface 14. In particular, the marker 50 indicates where the batter 46 initially places his toes for determining the proper stance on the training aid 10.

Figure 4:
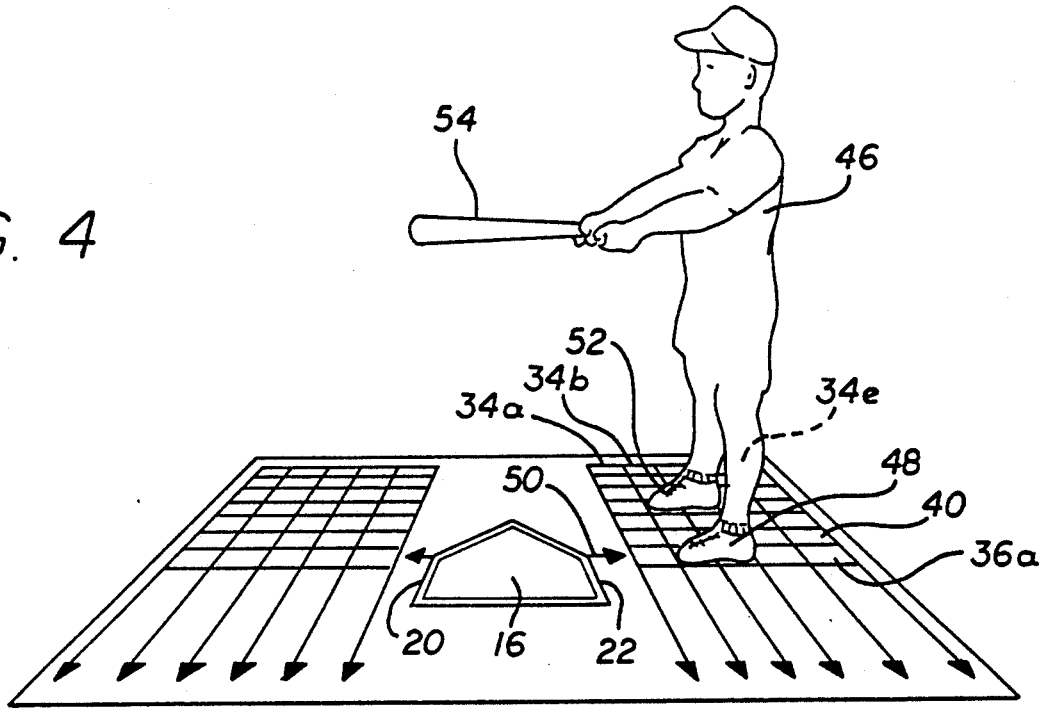
FIG. 4 is a perspective view illustrating the present invention when used to determine and train a proper stance.

Referring now to FIG. 4, once the batter 46 has placed the leading foot 48 in the "1" sector with the toes of the leading foot 48 abutting the marker 50, the batter 46 extends his arms and while gripping his bat, he backs directly away from the home plate indicium 16 until a free end 54 of the bat extends approximately two inches beyond the farther home plate side edge 20. Accordingly, the batter 46 has determined the proper distance at which he is to be positioned from the home plate indicium 16. To determine the proper width of his stance, the batter 46 places his other foot 52 directly across from his leading foot 48 at a width no greater than three inches wider than his shoulder width.

At this point, the toes of the batter's two feet 48 and 52 should primarily be in only one of the rows 34*a*–34*e*. And, as further indicated by the marker 50, the leading foot 48 should primarily remain in the column 36*a*. The batter 46 or his coach determines on which two of the sectors 32 the toes of the feet 48 and 52 are primarily positioned, and the batter 46 memorizes the locator symbols 40 in the two sectors 32 as his individual locator symbols.

Figure 5:
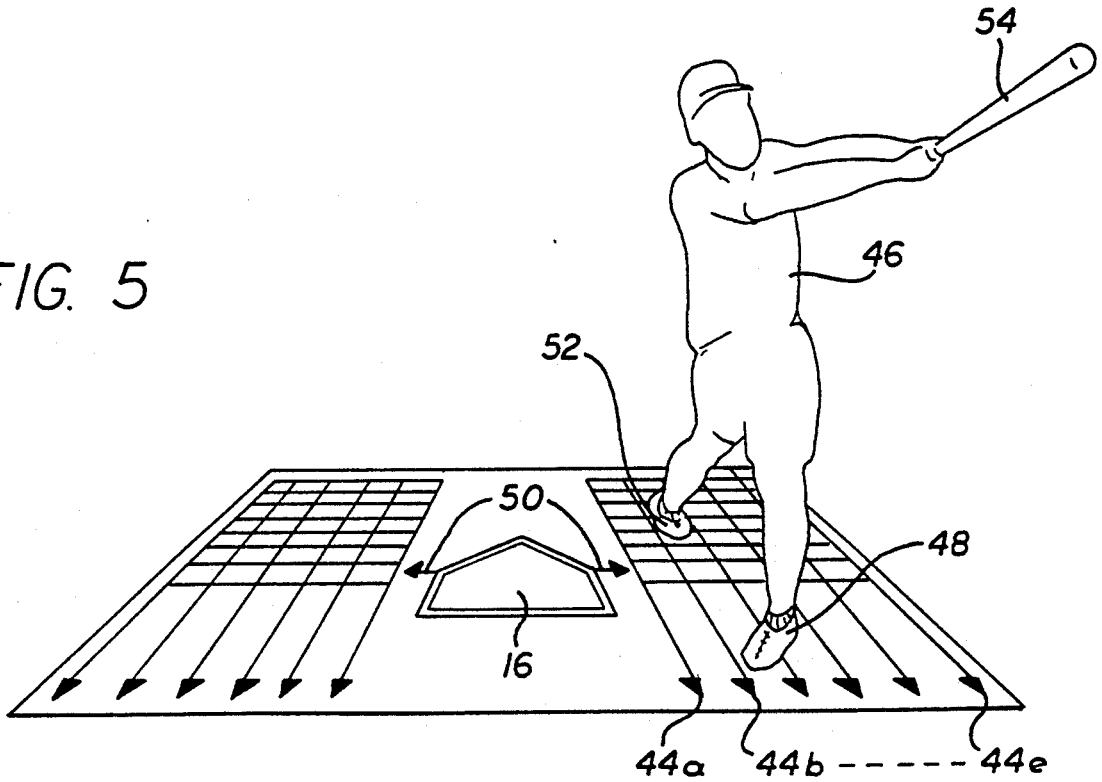
FIG. 5 is a perspective view illustrating the present invention when used to determine and train a proper stride.

In FIG. 5, upon swinging the bat, the leading foot 48 steps onto a stride indicium corresponding to the row on which the batter's proper stance is located, and the other foot 52 pivots. Specifically, the leading foot 48 is placed so that the toes substantially abut the linear designation of the stride indicium corresponding to the row on which the batter's proper stance is located.

To illustrate, in FIG. 4, the batter upon extending his arms while gripping a bat determines as described above his proper stance to be primarily "8" sector 32 for the toes of his leading foot 48 and "11" section 32 for the toes of his other foot 52. To be certain, it is determined that the "8" sector 32 and the "11" sector 32 are both in one row, namely, row 34*b* and that the "8" sector 32 is in column 36*a*. In FIG. 5, upon swinging the bat, the leading foot 48 of the batter 46 steps forward onto stride indicium 44*b* which corresponds to the row 34*b*, and the other foot 52 pivots on the "11" sector 32.

When the batter 46 bats again, he simply places the toes of his leading foot, again, on the "8" sector 32 and the toes of his other foot, again, on the "11" sector 32. The batter need not adjust the stance indicium 18 or measure the distance between the stance indicium 18 and the home plate indicium 16. To properly position himself, he need simply remember the two sectors 32 (containing the locator symbols 40) upon which he places his toes.

The plurality of feet position sectors 32 ensures that a batter of any given arm length using any given bat can determine his proper stance and maintain his proper stance whenever he bats. To accommodate smaller or younger participants with shorter arms, the distance at the numeral 38 between the "1" sector 32 and the home plate indicium 16 is substantially six inches in the disclosed embodiment. The training aid 10, however, also accommodates taller and older participants with longer arms as the row 34*e*. farthest from the home plate indicium 16 is substantially 23 inches from the home plate indicium 16 in the disclosed embodiment. Similarly, the columns 36*a*–36*g* accommodate both the smaller participants with narrower stances and the taller participants with wider stances. Moreover, in the disclosed embodiment, the length of the stride indicium 44*a*–44*e*. being substantially 18 inches also accommodates participants of varying stride length.

Batters may also easily determine a new proper stance and stride as necessary when they grow taller, or use different bats. When their dimensions change, the batters' stance and stride must change as well.

A set of instructions, or instruction indicia 54 (FIG. 1) on determining and training participants on their proper stances and strides are provided on the surface 14. In the disclosed embodiment, the instruction indicia 54 are a series of drawings or diagrams illustrating use of the training aid 10. The instruction indicia 54 are simple and easily understood. They are positioned adjacent the home plate indicium 16 and between the stance indicia 18 and 42 so that both left-handed and right-handed batters may use the instruction indicia 54 when standing on the stance indicia 18 and 42. The instruction indicia 54 may be deposited on the surface 14 in a manner similar to that of the indicia 16 and 18.

The present invention is simple and can be used by participants of all ages. By providing the stance indicia 18 and 42 with the distinct locator symbols 40, participants, especially the younger participants, can effortlessly position themselves in a proper batting stance. With their feet properly positioned, the batters, as well as their coaches, need not be concerned with the batter's stances, but rather are free to focus their attention on achieving on a proper swing.

Although the present invention has been described in terms of several embodiments thereof, other embodiments that are apparent to those of ordinary skill in the art are also within the scope of the invention. Accordingly, the scope of the invention is intended to be defined only by reference to the appended claims.

What is claimed is:

1. A stance and stride training aid for use on a support surface such as the ground for teaching a batter proper batting techniques, said training aid comprising:

a body positionable on said support surface and providing a substantially planar surface onto which the batter stands;

a home plate indicium positioned on said body;

a stance indicium positioned on said body adjacent said home plate indicium;

a plurality of stride indicia positioned on said body, said stride indicia extending linearly from said stance indicium.

2. A stance and stride training aid as described in claim 1, wherein said stance indicium is gridded to provide a plurality of rows and columns.

3. A stance and stride training aid as described in claim 2, wherein said gridded stance indicium provide a plurality of feet positioned sectors arranged in said rows and columns.

4. A stance and stride training aid as described in claim 3, wherein said stride indicia extend linearly from an end column of said stance indicium and are parallel with said rows of said stance indicium.

5. A stance and stride training aid as described in claim 4, further comprising distinct locator symbols within said feet positioning sectors.

6. A stance and stride training aid as described in claim 2, wherein said stride indicia extend linearly from an end column of said stance indicium and are parallel with said rows of said stance indicium.

7. A stance and stride training aid as described in claim 2, wherein each of said plurality of stride indicia corresponds to one distinct row of said stance indicium.

8. A stance and stride training aid as described in claim 1, further comprising:

a second stance indicium positioned on said body adjacent said home plate indicium, but opposing said stance indicium; and a second plurality of stride indicia positioned on said body, said second plurality of stride indicia extending linearly from said second stance indicium and opposing said plurality of stride indicia extending linearly from said stance indicium.

9. A stance and stride training aid as described in claim 1, further comprising instruction indicia positioned on said body.

10. A stance and stride training aid as described in claim 1, wherein said home plate indicium is removably attached to said body.

11. A stance and stride training sheet for teaching a batter proper batting techniques, said training sheet providing a surface onto which the batter stands, wherein said surface comprises:

a home plate indicium;

two feet positioning indicia arranged on opposite sides of said home plate indicium, each of said feet positioning indicia being gridded for providing a plurality of rectangles arranged in rows and columns where each of said rectangles contains a distinct locator symbol; and a plurality of stride indicia, said stride indicia being substantially linear designations extending from end columns of said feet positioning indicia.

12. A stance and stride training aid as described in claim 11, further comprising instruction indicia.

* * * * *

UNITED STATES PATENT AND TRADEMARK OFFICE

CERTIFICATE OF CORRECTION

PATENT NO. : 5,330,176
DATED : July 19, 1994
INVENTOR(S) : Richard D. Cagney, Jr.

It is certified that error appears in the above-indentified patent and that said Letters Patent is hereby corrected as shown below:

Column 6, line 54, change "3" to --2--;

Column 6, line 57, change claim "5" to --6--;

Column 6, line 58, change "4" to --5--;

Column 6, line 60, change claim "6" to --5--; and

Column 6, line 61, change "2" to --3--.

Signed and Sealed this

Eleventh Day of October, 1994

*Attest:*

*Attesting Officer*

Bruce Lehman

BRUCE LEHMAN

*Commissioner of Patents and Trademarks*